US006745398B1

(12) United States Patent
Hennessey

(10) Patent No.: US 6,745,398 B1
(45) Date of Patent: Jun. 8, 2004

(54) SAFETY PANTS WITH REMOVABLE KNEE PADS

(76) Inventor: James A. Hennessey, 47 Union Valley Rd., Mahopac, NY (US) 10541

( * ) Notice: Subject to any disclaimer, the term of this patent is extended or adjusted under 35 U.S.C. 154(b) by 0 days.

(21) Appl. No.: 10/455,961

(22) Filed: Jun. 6, 2003

(51) Int. Cl.[7] ..... A41D 13/00
(52) U.S. Cl. ..... 2/23
(58) Field of Search ..... 2/455, 79, 227, 2/23, 24, 46, 247, 267, 69, 62

(56) References Cited

U.S. PATENT DOCUMENTS 3,168,746 A * 2/1965 Smith ..... 2/24
4,561,124 A 12/1985 Thompson
4,613,991 A 9/1986 Grover
4,831,666 A 5/1989 Denman
4,920,577 A * 5/1990 Scharf ..... 2/24
5,038,408 A 8/1991 Debaene
5,106,473 A * 4/1992 Whitlaw et al. ..... 205/150
5,551,084 A * 9/1996 Freese, III ..... 2/23
5,729,832 A * 3/1998 Grilliot et al. ..... 2/23
D393,141 S 4/1998 Glycenfer
5,920,902 A 7/1999 Crampton

* cited by examiner

*Primary Examiner*—Tejash Patel

(57) ABSTRACT

A safety pants with removable knee pads for providing a user with a pair of pants that would incorporate pockets which could house knee protection. The safety pants with removable knee pads include a pair of pants. The pants have a lower torso portion and two legs. Each of the legs has a front knee portion. Each one of a pair of pads has a size designed for covering one of the front knee areas. Each one of the pads provides a cushioning between a horizontal support surface and knees of a user when the user is in a kneeling position. A fastening assembly is for fastening each one of the pair of pads to an associated one of the legs for covering the knees of a user.

16 Claims, 2 Drawing Sheets

SAFETY PANTS WITH REMOVABLE KNEE PADS

BACKGROUND OF THE INVENTION

1. Field of the Invention

The present invention relates to pants and more particularly pertains to a new safety pants with removable knee pads for providing a user with a pair of pants that would incorporate pockets which could house knee protection.

2. Description of the Prior Art

The use of pants is known in the prior art. U.S. Pat. No. 5,920,902 describes knee pads for work pants having a pad held in place between the inside of the knee area of work pant leg and a rectangular fabric piece that is attached to the pant leg. Another type of pant is U.S. Pat. No. 5,038,408 describes work pants for use when performing work in which sitting and kneeling take place frequently. U.S. Pat. No. Des. 393,141 describes an ornamental design for work pants with kneeling pad pockets. U.S. Pat. No. 4,831,666 describes a garment especially adapted for protecting the knees while gardening. U.S. Pat. No. 4,613,991 describes a pair of work pants particularly designed for kneeling work activity having removable leather patches covering the knee area. U.S. Pat. No. 4,561,124 describes knee padding for work pants.

SUMMARY OF THE INVENTION

The object of the present invention is to provide a new safety pants with removable knee pads that would provide a cushioned surface for the knees to prevent nerve or cartilage damage.

Another object of the present invention is to provide a new safety pants with removable knee pads that could be easily removed for laundering, replacement, or when not needed.

To this end, the present invention generally comprises a pair of pants. The pants have a lower torso portion and two legs. Each of the legs has a front knee portion. Each one of a pair of pads has a size designed for covering one of the front knee areas. Each one of the pads provides a cushioning between a horizontal support surface and knees of a user when the user is in a kneeling position. A fastening assembly is for fastening each one of the pair of pads to an associated one of the legs for covering the knees of a user.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
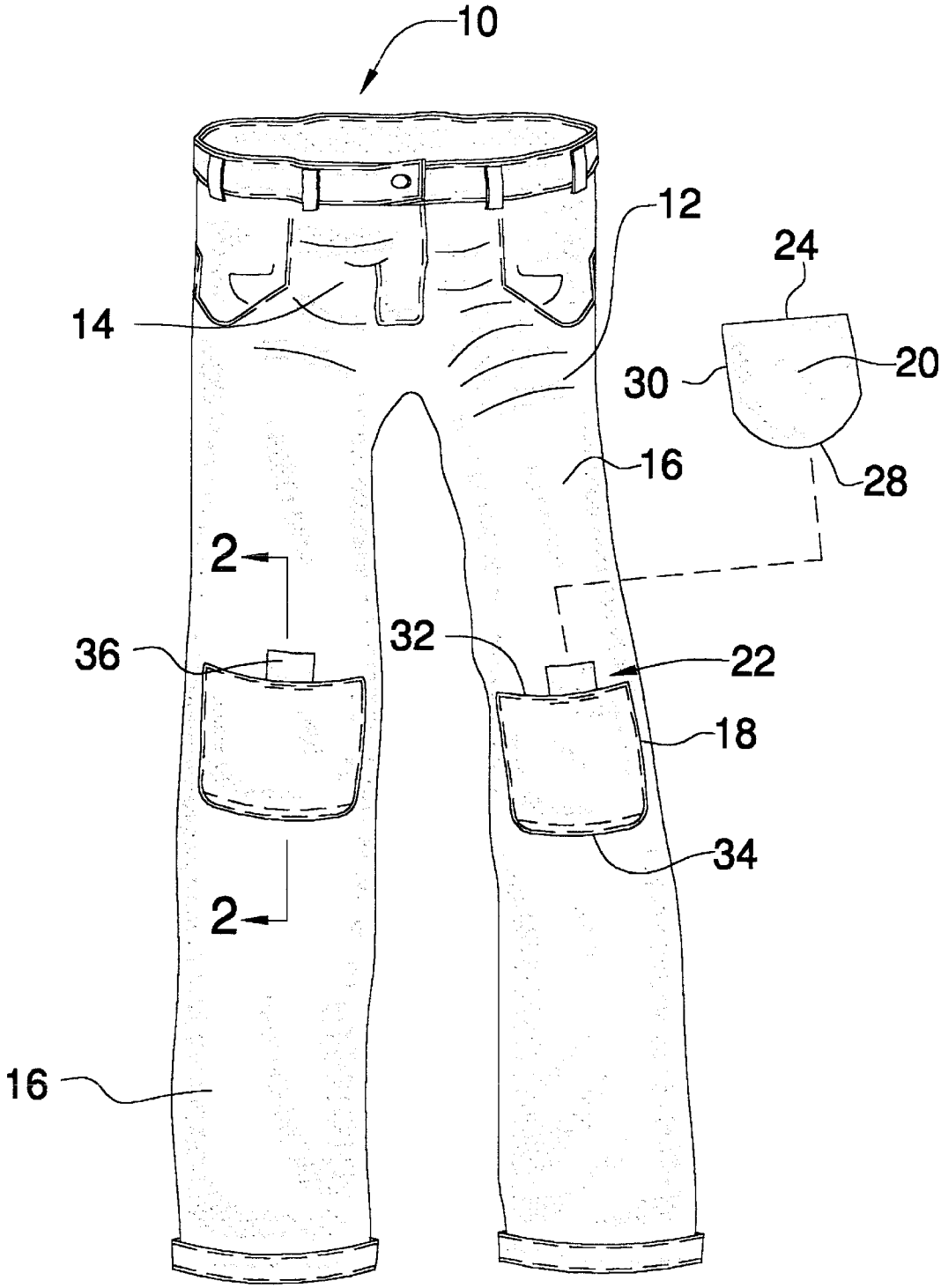
FIG. 1 is a front view of a new safety pants with removable knee pads according to the present invention.
Figure 2:
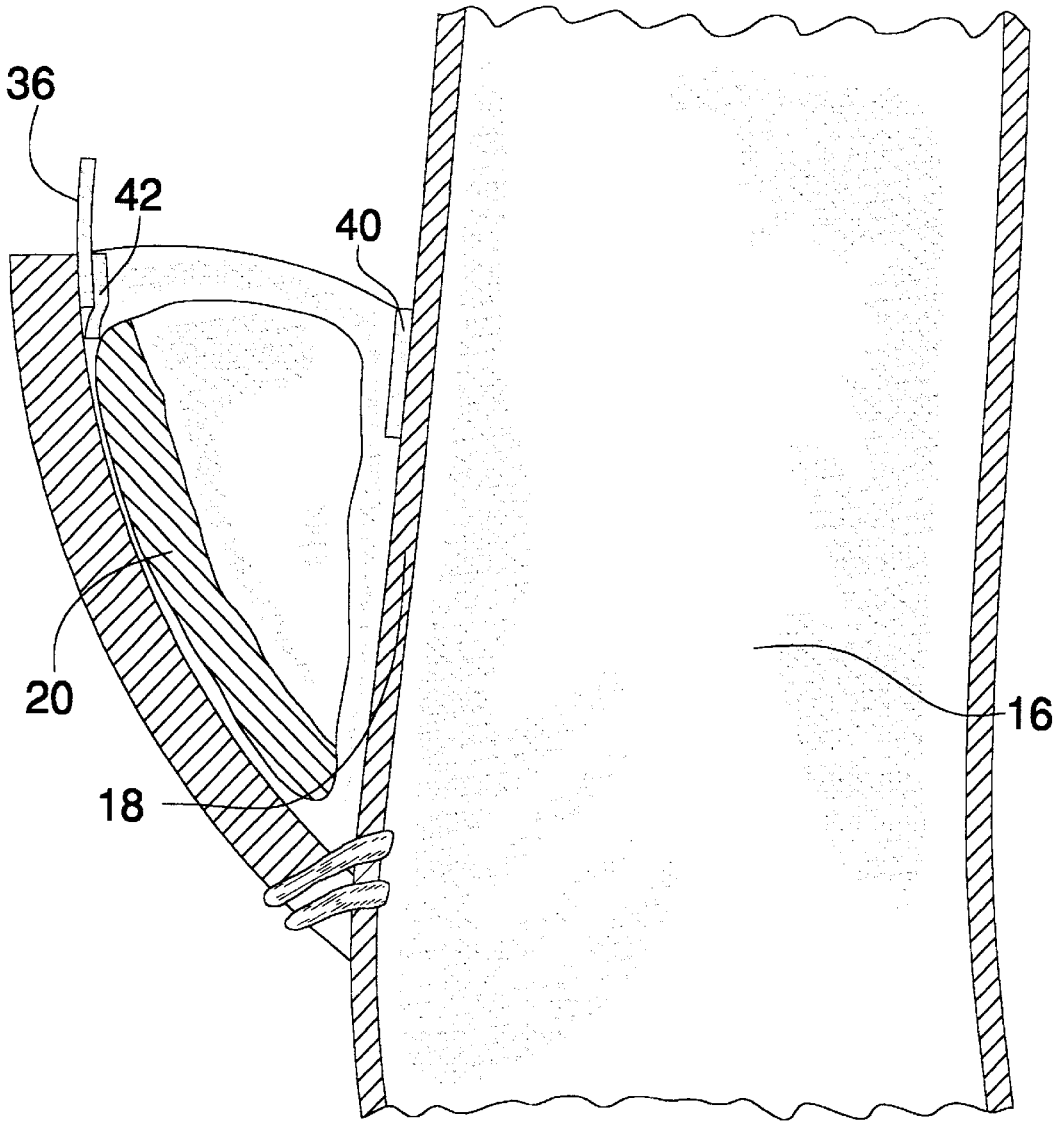
FIG. 2 is a cross-sectional view of the present invention.

With reference now to the drawings, and in particular to FIGS. 1 through 2 thereof, a new safety pants with removable knee pads embodying the principles and concepts of the present invention and generally designated by the reference numeral 10 will be described.

As best illustrated in FIGS. 1 through 2, the safety pants with removable knee pads 10 generally comprises a pair of pants 12. The pants 12 have a lower torso portion 14 and two legs 16. Each of the legs 16 has a front knee portion 18. Each one of a pair of pads 20 has a size designed for covering one of the front knee areas. Each one of the pads 20 provides a cushioning between a horizontal support surface and knees of a user when the user is in a kneeling position. A fastening assembly 22 is for fastening each one of the pair of pads 20 to an associated one of the legs 16 for covering the knees of a user.

Each of the pads 20 has a top wall 24 for facilitating insertion and removal of the pads 20 into the pocket 26. An arcuate bottom wall 28 curves upward and joins a pair of side walls 30. Each of the pads 20 is for protectively covering the knee area of a user. Each of the pads 20 has a generally curved shape for facilitating the fit of the pads 20 around the front knee areas of a user. Each of the pads 20 has a u-shaped cross-section. The pads 20 are constructed of a cushioning material such as foam rubber.

A pocket 26 is sized slightly larger that the pads 20 for providing a snug fit for the pads 20. Each one of the pads 20 is slidably received by an associated one of the pockets 26. The pocket 26 has three sides coupled to the front knee portion 18. The pocket 26 has an open end 32 positioned opposite a closed bottom end 34 for facilitating insertion of the pad 20 into the pocket 26. The three sides of the pocket 26 are double stitched to prevent the pocket 26 from being separated from the front knee portion 18. Preferably, the pocket is square along the bottom and sides.

The pocket 26 further includes a tab portion 36. The tab portion 36 is coupled to the open end for facilitating closure of the pocket 26 to the front knee portion 18.

The fastening assembly further includes a hook and loop fastener means 38 attached to the pants 12 and the tab portion 36. A first portion 40 of a hook and loop fastener 38 is coupled to the pants 12. A second portion 42 of a hook and loop fastener 38 is coupled to the tab portion 36. The first portion 40 and the second portion 42 are complimentary.

In a preferred embodiment, the tab portion 36 is positioned between the material of the pocket 26, and second portion 42 of the hook and loop fastener 38 to improve durability of the tab portion 36 and the effectiveness of the tap portion 36 in opening the pocket 26.

In an embodiment, the fastening assembly extends along an entire length of the top edge of the pocket.

In use, a user would place a pad into the pocket located on the knee portion of the pants and secure the open end of the pocket to the pants utilizing the hook and loop fastener. The pad would be in position to protect the knee of the user when kneeling on a horizontal support surface such as a floor.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A pant knee pad combination system for protecting the knees of a user comprising:

a pair of pants, said pants having a lower torso portion and two legs, each of said legs having a front knee portion;

a pair of pads, each of said pads having a size adapted for covering one of said front knee areas; each of said pads providing a cushioning between a horizontal support surface and knees of a user when the user is in a kneeling position;

a fastening assembly for fastening each one of said pair of pads to an associated one of said legs for covering the knees of a users;

each one of said two legs having a pocket being sized slightly larger that said pads for providing a snug fit for said pads, when each one of said pads are slidably received by an associated one of said pockets; and said pocket further comprises a tab portion, said tab portion being coupled to said open end for facilitating closure of said pocket to said front knee portion.

2. The system of claim 1, wherein each of said pads has a top wall for facilitating insertion and removal of said pads into said pocket, an arcuate bottom wall curves upward and joins a pair of side walls, each of said pads being for protectively covering the knee area of a user.

3. The system of claim 2, wherein each of said pads having a generally curved shape for facilitating the fit of said pads around the front knee areas of a user, each of said pads having a u-shaped cross-section.

4. The system of claim 2, wherein said pads being constructed of a cushioning material such as foam rubber.

5. The system of claim 1, wherein said pocket having three sides coupled to said front knee portion, said pocket having an open end positioned opposite a closed bottom end for facilitating insertion of said pad into said pocket.

6. The system of claim 5, wherein said three sides of said pocket being double stitched to prevent said pocket from being separated from said front knee portion.

7. The system of claim 1, wherein said fastening assembly further comprises a hook and loop fastener means attached to said pants and said tab portion;

a first portion of a hook and loop fastener is coupled to said pants;

a second portion of a hook and loop fastener is coupled to said tab portion;

said first portion and said second being complimentary.

8. A pant knee pad combination system for protecting the knees of a user comprising:

a pair of pants, said pants having a lower torso portion and two legs, each of said legs having a front knee portion;

a pair of pads, each of said pads having a size adapted for covering one of said front knee areas; each of said pads providing a cushioning between a horizontal support surface and knees of a user when the user is in a kneeling position;

a fastening assembly for fastening each one of said pair of pads to an associated one of said legs for covering the knees of a user;

wherein each of said pads has a top wall for facilitating insertion and removal of said pads into said pocket, an arcuate bottom wall curves upward and joins a pair of side walls, each of said pads being for protectively covering the knee area of a user;

wherein each of said pads having a generally curved shape for facilitating the fit of said pads around the front knee areas of a user, each of said pads having a u-shaped cross-section;

wherein said pads being constructed of a cushioning material such as foam rubber;

wherein a pocket being sized slightly larger that said pads for providing a snug fit for said pads, when each one of said pads are slidably received by an associated one of said pockets;

wherein said pocket having three sides coupled to said front knee portion, said pocket having an open end positioned opposite a closed bottom end for facilitating insertion of said pad into said pocket;

wherein said three sides of said pocket being double stitched to prevent said pocket from being separated from said front knee portion;

wherein said pocket further comprises a tab portion, said tab portion being coupled to said open end for facilitating closure of said pocket to said front knee portion;

wherein said fastening assembly further comprises a hook and loop fastener means attached to said pants and said tab portion;

a first portion of a hook and loop fastener is coupled to said pants;

a second portion of a hook and loop fastener is coupled to said tab portion; and said first portion and said second being complimentary.

9. A pant knee pad combination system for protecting the knees of a user comprising:

a pair of pants, said pants having a lower torso portion and two legs, each of said legs having a front knee portion;

a pair of pads, each of said pads having a size adapted for covering one of said front knee areas; each of said pads providing a cushioning between a horizontal support surface and knees of a user when the user is in a kneeling position;

a fastening assembly for fastening each one of said pair of pads to an associated one of said legs for covering the knees of a user;

each one of said two legs having a pocket being sized slightly larger that said pads for providing a snug fit for said pads, when each one of said pads are slidably received by an associated one of said pockets; and said pocket further comprises a tab portion, said tab portion being coupled to said open end for facilitating closure of said pocket to said front knee portion, said tab positioned medially on said open end, said tab extending upwardly beyond a peripheral edge of said pocket.

10. The system of claim 9, wherein each of said pads has a top wall for facilitating insertion and removal of said pads into said pocket, an arcuate bottom wall curves upward and joins a pair of side walls, each of said pads being for protectively covering the knee area of a user.

11. The system of claim 10, wherein each of said pads having a generally curved shape for facilitating the fit of said pads around the front knee areas of a user, each of said pads having a unshaped cross-section.

12. The system of claim 10, wherein said pads being constructed of a cushioning material such as foam rubber.

13. The system of claim 9, wherein said pocket having three sides coupled to said front knee portion, said pocket having an open end positioned opposite a closed bottom end for facilitating insertion of said pad into said pocket.

14. The system of claim 13, wherein said three sides of said pocket being double stitched to prevent said pocket from being separated from said front knee portion.

15. The system of claim 9, wherein said fastening assembly further comprises a hook and loop fastener means attached to said pants and said tab portion;

a first portion of a hook and loop fastener is coupled to said pants;

a second portion of a hook and loop fastener is coupled to said tab portion;

said first portion and said second being complimentary.

16. A pant knee pad combination system for protecting the knees of a user comprising:

a pair of pants, said pants having a lower torso portion and two legs, each of said legs having a front knee portion;

a pair of pads, each of said pads having a size adapted for covering one of said front knee areas; each of said pads providing a cushioning between a horizontal support surface and knees of a user when the user is in a kneeling position;

a fastening assembly for fastening each one of said pair of pads to an associated one of said legs for covering the knees of a user;

wherein each of said pads has a top wall for facilitating insertion and removal of said pads into said pocket, an arcuate bottom wall curves upward and joins a pair of side walls, each of said pads being for protectively covering the knee area of a user;

wherein each of said pads having a generally curved shape for facilitating the fit of said pads around the front knee areas of a user, each of said pads having a u-shaped cross-section;

wherein said pads being constructed of a cushioning material such as foam rubber;

wherein a pocket being sized slightly larger that said pads for providing a snug fit for said pads, when each one of said pads are slidably received by an associated one of said pockets;

wherein said pocket having three sides coupled to said front knee portion, said pocket having an open end positioned opposite a closed bottom end for facilitating insertion of said pad into said pocket;

wherein said three sides of said pocket being double stitched to prevent said pocket from being separated from said front knee portion;

wherein said pocket further comprises a tab portion, said tab portion being coupled to said open end for facilitating closure of said pocket to said front knee portion, said tab positioned medially on said open end, said tab extending upwardly beyond a peripheral edge of said pocket;

wherein said fastening assembly further comprises a hook and loop fastener means attached to said pants and said tab portion;

a first portion of a hook and loop fastener is coupled to said pants;

a second portion of a hook and loop fastener is coupled to said tab portion; and said first portion and said second being complimentary.

* * * * *